US005688446A

United States Patent [19]

Glenn

[11] Patent Number: 5,688,446

[45] Date of Patent: Nov. 18, 1997

[54] EVAPORATIVE HUMIDIFIER

[75] Inventor: Neville R. Glenn, Milford, Mass.

[73] Assignee: Holmes Products Corp., Milfrod, Mass.

[21] Appl. No.: 670,345

[22] Filed: Jun. 25, 1996

Related U.S. Application Data

[63] Continuation of Ser. No. 222,295, Apr. 4, 1994, Pat. No. 5,529,726.

[51] Int. Cl.[6] ..... B01F 3/04

[52] U.S. Cl. ..... 261/142

[58] Field of Search ..... 261/142, 30, 107

[56] References Cited

U.S. PATENT DOCUMENTS

| | | | |
|---|---|---|---|
| 1,991,581 | 2/1935 | Shelor | 261/107 |
| 2,032,634 | 3/1936 | Ross | 261/107 |
| 2,092,630 | 9/1937 | Bailey | 261/142 |
| 2,827,270 | 3/1958 | Martin | 261/107 |
| 3,193,261 | 7/1965 | Nesbitt | 261/142 |
| 3,274,993 | 9/1966 | Martin | 261/92 |
| 3,321,931 | 5/1967 | Lehmkuhl | 261/30 |
| 4,089,915 | 5/1978 | Jackson | 261/142 |
| 4,166,087 | 8/1979 | Cline et al. | 261/30 |
| 4,225,542 | 9/1980 | Wall et al. | 261/142 |
| 4,694,142 | 9/1987 | Glucksman | 219/371 |
| 4,698,188 | 10/1987 | Gutmann | 261/107 |
| 4,752,423 | 6/1988 | Wong | 261/142 |
| 4,830,791 | 5/1989 | Muderlak et al. | 261/30 |
| 4,839,014 | 6/1989 | Park et al. | 261/107 |
| 5,014,338 | 5/1991 | Glucksman | 392/405 |
| 5,037,583 | 8/1991 | Hand | 261/107 |
| 5,037,586 | 8/1991 | Mehrholz et al. | 261/142 |
| 5,143,655 | 9/1992 | Chiu et al. | 261/107 |

FOREIGN PATENT DOCUMENTS

| | | | |
|---|---|---|---|
| 362821 | 8/1962 | Switzerland | 261/107 |

*Primary Examiner*—Tim R. Miles

*Attorney, Agent, or Firm*—Hoffmann & Baron, LLP

[57] ABSTRACT

An evaporative humidifier includes a base having a portion defining a reservoir for holding a quantity of water. A housing is mounted on the base over the reservoir, the housing having an air inlet and an air outlet. A cylindrically shaped wick filter is seated in the reservoir and extends up into the housing, the cylindrically shaped wick filter having an open top end and a sidewall. A fan is mounted inside the housing for drawing air into the housing through the air inlet, then into the center of the cylindrically shaped wick filter through the open top end, then out through the sidewall of the cylindrically shaped wick filter and then out of the housing through the air outlet. A heater is also mounted inside the housing for heating the air drawn into the housing prior to passage through the cylindrically shaped wick filter.

12 Claims, 6 Drawing Sheets

EVAPORATIVE HUMIDIFIER

This application is a continuation of application Ser. No. 08/222,295,filed on Apr. 4, 1994, now U.S. Pat. No. 5,529,726.

BACKGROUND OF THE INVENTION

The present invention relates generally to humidifiers and more particularly to evaporative humidifiers.

Humidifiers have been found to be very useful in raising the humidity of air present inside homes, particularly during periods of very dry weather or in winter, when outside air of low temperature is drawn inside a home and heated, causing the relative humidity within the home to be lowered to an uncomfortable level.

Various types or classes of humidifiers are well-known in the art. Examples of such include steam-type humidifiers, ultrasonic humidifiers, warm-air humidifiers and evaporative humidifiers. Steam-type humidifiers generally comprise a water container and an electric heating element submerged in the water, there being provided safety devices for switching off the current as soon as the water level drops below the heating element. A flow of hot steam is blown directly into the room to be humidified.

Ultrasonic humidifiers generally comprise a container filled with water which is brought to vibration by high-frequency vibrator means which causes the water to be atomized. An air stream directed onto the water surface carries the mist into the room to be humidified.

Warm-air humidifiers are similar to steam-type humidifiers in that water is heated to the boiling point. However, the steam generated by warm-air humidifiers is carried into a room as a mist mixed with air, at a temperature to be selected by judiciously choosing the ratio of steam to air.

Evaporative humidifiers generally include an open vessel containing a reservoir of cold water, a porous medium structure partly submerged in the cold water and a blower unit for drawing air through the porous medium structure. The porous medium is typically either (1) in the shape of a disc or a drum with part of the medium dipping into the water, the disc or drum being slowly rotated while air is blown through the portion above the water level, thus carrying humidity into the room; or (2) in the form of a stationary body adapted to draw water into the upper non-immersed part by capillary action, such as in the case of a wicking filter, the water on the upper non-immersed portion of the stationary body being discharged into the room by air blown therethrough.

In U.S. Pat. No. 4,225,542, inventors Wall et al., which issued Sep. 30, 1980, there is disclosed an evaporative humidifier with a humidification chamber of about 200 cc internal volume having an inlet connection port and an exit connection port for gases, a liquid reservoir and a removable porous evaporative element of open-ended cylindrical design which fits loosely within the humidification chamber when dry but which swells into good thermal contact with the side walls of the chamber when wet and which extends into the liquid reservoir. The chamber is tightly surrounded by a heating element so that heat is transferred directly to the chamber walls adjacent to the porous removable evaporative element and not to the liquid reservoir. The heating element is preferentially equipped with suitable electronic controls to monitor the heat transfer surface temperature, and to shut the unit off when said temperature exceeds a predetermined level. The humidifier is designed so that the gases reaching the patient will be at 100% relative humidity under most conditions of gas flow and heater temperature settings.

In U.S. Pat. No. 4,752,423, inventor Wong, which issued Jun. 21, 1988, there is described a combined humidifier and fan heater unit which includes a humidifier part electrically operable to dispense water vapor into the surrounding air space for humidifying purposes, and a fan heater part electrically operable either together with or instead of the humidifier part to draw air from the surrounding air space, through heating means, by which it is raised in temperature or not as desired, and passed back into the surrounding air space.

In U.S. Pat. No. 4,089,915, inventor Jackson, which issued May 16, 1978, there is described a self-sterilizing humidifier for air to be breathed, the humidifier being of the type having an endless porous media driven to be progressively immersed in a receptacle. Means are shown for periodically providing throughout the effective volume of water in the receptacle heated water at a temperature above about 180° F. while the media drive is actuated, the heated water being sufficient to progressively expose the media to bacteria-killing conditions. In one embodiment a heater chamber automatically discharges a charge of water heated above about 180° F. into the receptacle. In one such case a thermal actuator has sensitive parts exposed to water in both the heater chamber and the receptacle, the actuator releasing the charge when water in the receptacle lies below its sensitive part, and water in the heater chamber has reached or exceeds the selected high temperature. In another embodiment the heater element is in the receptacle and is periodically energized to maintain bacteria-killing conditions while the blower in the air flow path is de-energized to reduce evaporative cooling of the media and water during the sterilization interval.

In U.S. Pat. No. 5,037,586, inventors Mehrholz et al., which issued Aug. 6, 1991, there is described a humidifier which can be mounted in limited and a variety of different shaped spaces in a building such as a condominium or apartment, the humidifier comprising a centrifugal blower driven by an adjustable speed motor mounted in a cube-shaped module so that an outlet from the blower can be mounted on any selected side of the module such as any of the sidewalls or the top or bottom. A humidifier unit is selectively connectable to the centrifugal blower cube-shaped module and a preheater can be connected to the input of the humidifier. A water supply and drain can be connected to the humidifier and the output of the blower may be connected to the heat ducts to distribute the humidified air. Means are provided for mixing ambient air into the input of the blower, if desired. A drain safety switch may be provided to turn off the unit if the drain becomes clogged and also to remove excess water from the collecting pan. The unit may be connected to a remote digital electronic sensor humidistat having single or multiple stages or may include an integral humidistat in the unit.

In U.S. Pat. No. 3,193,261, inventor Nesbitt, which issued Jul. 6, 1965, there is described a humidifier designed to deliver air cleansed of air-borne particles, free of large water droplets and containing a maximum amount of moisture, the humidifier comprising a housing provided with relatively spaced air inlet and outlet openings that are separated by a baffle member which obstructs the direct flow of air from the air inlet opening to the air outlet opening. In passing through the humidifier, the circulated air, because of the baffle member and the relative positioning of the air inlet and outlet openings, is made to undergo a marked change in direction prior to being discharged from the humidifier. Atomizing means is also provided within the humidifier and is so positioned in the air stream as to generate a water vapor cloud upstream of the point at which the circulated air must undergo the marked change in direction. An air flow pattern is thus defined whereby air is drawn in through the air inlet opening, directed through the water vapor cloud to pick up moisture, undergoes a marked change in direction and then passes through the outlet opening. The larger water droplets and air borne particles, being relative heavy, resist the change in direction and are separated from the main air stream, so that the air, which is discharged from the outlet opening, contains moisture in only the most finely divided form and is cleansed of substantially all foreign particles. To insure the addition of a maximum amount of moisture to the air, the atomizing means also includes a heating element. The heating element, in addition to contributing to the formation of the water vapor cloud, increases the temperature of the air to be treated and correspondingly increases its moisture carrying capacity.

In U.S. Pat. No. 5,014,338, inventor Glucksman, which issued May 7, 1991, there is described a portable warm-air humidifier, the components of which are enclosed in a housing. The components include an evaporation chamber in the shape of an inverted cup which has a steam outlet in its top and contains an electric heating element positioned at a short distance above its open bottom. The chamber bottom and the heating elements are immersed in water contained in the main compartment of an open, removable tray, having a smaller filling compartment communicating with the main compartment. The tray may be removed from the housing for cleaning. The neck of an inverted, removable jug filled with water is placed into the filling compartment, and water fills the tray until its level reaches the lower rim of the jug's neck. A blower is mounted above the evaporation chamber and delivers cool air through a duct which communicates with the evaporation chamber via its steam outlet, and humidified air is blown back into the room. The humidifier also contains a control element to prevent damage to the heating element and signal lamps warning an attendant to refill the jug with water. The humidifier may also include a removable drawer.

SUMMARY OF THE INVENTION

It is an object of this invention to provide a new and improved evaporative humidifier.

It is another object of this invention to provide an evaporative humidifier wherein the intake air is heated before moisture is added to it.

It is still another object of this invention to provide an evaporative humidifier which includes a new and improved flow path of air into, through and out of the unit.

An evaporative humidifier constructed according to one feature of this invention comprises a base including a portion defining a reservoir for holding water, a housing mounted on said base over said reservoir, said housing having an air inlet and an air outlet, a cylindrically shaped wick filter seated in said reservoir and extending into said housing, said cylindrically shaped wick filter having an open end and a sidewall, and a fan inside said housing for drawing air into said housing through said air inlet then into the center of said cylindrically shaped wick filter through said open end, then out through said sidewall of said cylindrically shaped wick filter and then out of said housing through said air outlet.

An evaporative humidifier constructed according to another feature of this invention comprises a base including a portion defining a reservoir for holding water, a housing mounted on said base over sad reservoir, said housing having an air inlet and an air outlet, a cylindrically shaped wick filter seated in said reservoir and extending into said housing, said cylindrically shaped wick filter having an open end and a sidewall, a fan inside said housing for drawing air into said housing through said air inlet, then into the center of said cylindrically shaped wick filter through said open end, then out through said sidewall of said cylindrically shaped wick filter and then out of said housing through said air outlet and a heater inside said housing for heating the air drawn into said housing prior to passage through said cylindrically shaped wick filter.

Various features and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the air to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
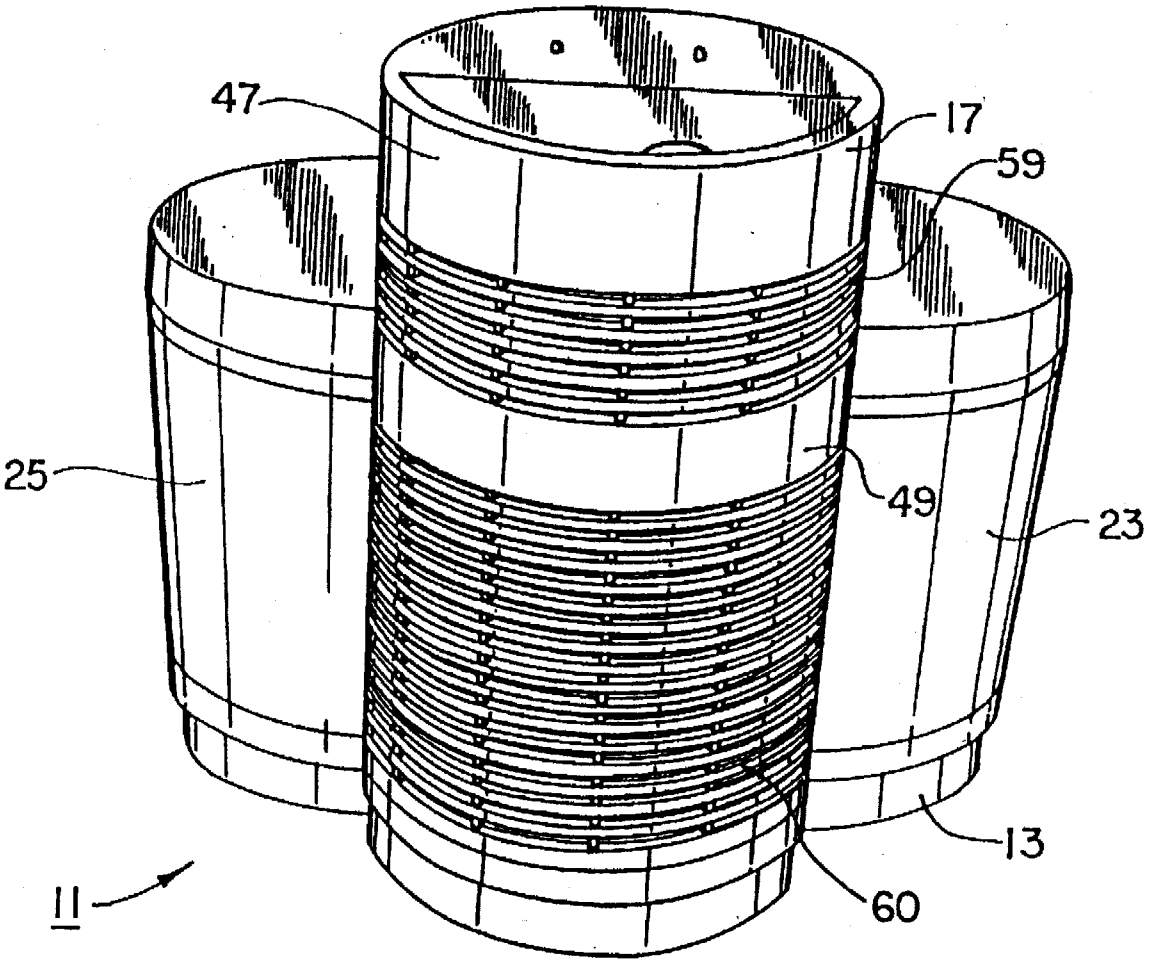
FIG. 1 is a perspective view of an evaporative humidifier constructed according to the teachings of this invention.
Figure 2:
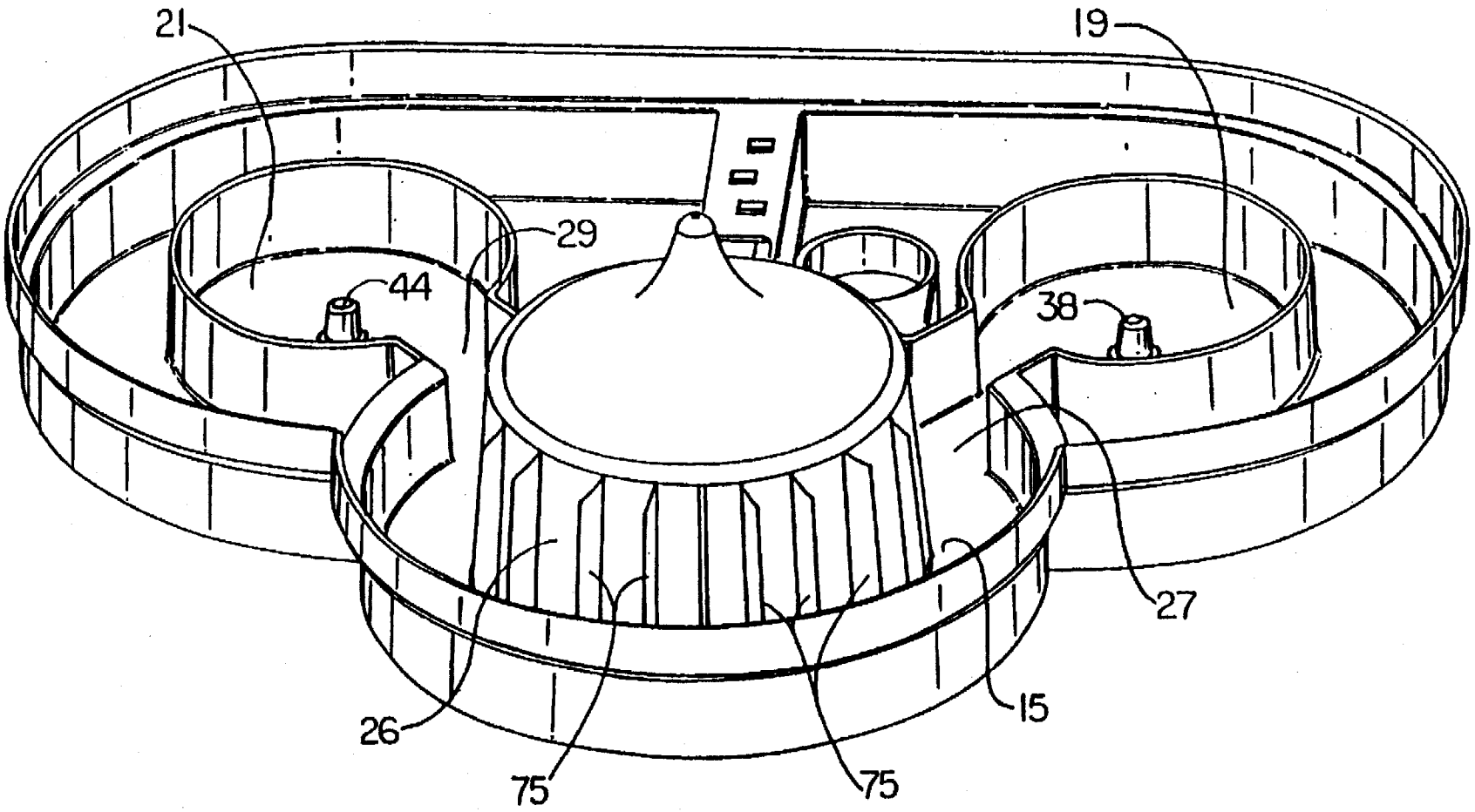
FIG. 2 is a perspective view of the base shown in the evaporative humidifier in FIG. 1.

The present invention is directed to an evaporative humidifier in which the air is heated before it is passed through a wick type filter and wherein air enters and exits the unit from the side.

Referring now to the drawings, there is shown an evaporative humidifier constructed according to this invention and identified by reference numeral 11.

For simplicity, attaching hardware such as nuts and bolts and other pals not pertinent to the invention are not shown.

Evaporative humidifier 11 includes a base 13 having a central portion shaped to define a reservoir 15 for removably receiving a housing 17 in which humidification takes place. Base 13 also includes a pair of end portions shaped to define enclosures 19 and 21 for removably receiving water supply tanks 23 and 25 for holding a supply of water to be used in the humidification process. Reservoir 15 includes an upwardly extending hub 26. Enclosure 19 has an opening 27 leading into reservoir 15 and enclosure 21 has an opening 29 leading into reservoir 15.

Water supply tank 23 includes a sidewall 31, a top 33 and a bottom 35. A valve assembly 37 is removably mounted in an opening 38 in bottom 35, opening 38 serving as both a filling port and an exiting port. Valve assembly 37 is positioned to engage a valve opening protrusion 38 in enclosure 19 on base 13. Water supply tank 25 includes a sidewall 39, a top 41 and a bottom 43. A valve assembly 45 is removably mounted in an opening 46 in bottom 43 and in positioned to engage a valve opening protrusion 44 in enclosure 21 on base 13. Opening 46 also serves as a filling port and an exiting port.

Housing 17 is generally cylindrically shaped and includes a top 47, a sidewall 49 and an open bottom. Top 47 includes a lid 51 that can be pivotally opened to access a control panel 53 having switches 54 for controlling the operation of evarporative humidifier 11. Sidewall 49 is made up of a front section 55 and a rear section 57, the two sections being attached to each other by screws (not shown). The top portion of sidewall 49 is shaped to form an air inlet grille 59, the front part 59-1 of inlet grille 59 being on front section 55 and the rear part 59-2 of inlet grille being on rear section 57. The bottom portion of front section 55 is shaped to define an air outlet grille 60.

Evaporative humidifier 11 further includes a wick filter 61, a fan 63, an air deflector 65, and a heater 67

Wick filter 61 is cylindrically shaped and includes a sidewall 69, an open top 71 and an open bottom 73. Wick filter 61 is removably seated in reservoir 15 and extends up vertically into housing 17. Ribs 75 extending radially out from hub 26 in reservoir 15 serve to hold wick filter 61 in its cylindrical shape.

Fan 63 is located above wick filter 61 in axial alignment therewith and serves to draw air into housing 17 through air inlet grille 59, move the air drawn into housing 17 along a flow path to be described below where it is heated and picks up moisture and then exhaust the air from housing 17 through outlet grille 60. Fan 63 includes a motor 69 and a set of blades 71.

Air deflector 65, which is generally circular disk shaped, is removably seated on the top of wick filter 61 above open end 71 and serves to deflect the air drawn in by fan 63 so that it all travels down into the center of wick filter 61.

Heater 67 is a cylindrical cage shaped resistance heater and serves to heat the air drawn in through inlet grille 59. An example of a cylindrical cage shaped resistance heater may be found in U.S. Pat. No. 4,694,142 to Dov Z. Glucksman. Heater 67 is positioned above fan blades 71 in axial alignment with wick filter 61.

Fan 63 and heater 67 are fixedly attached to a mount 73 which is mounted on an internal flange 75 on housing 17.

Evaporative humidifier also includes a float switch 77 for turning off the unit when the water in reservoir 13 is below a certain level and a power plug 79. Switch 77 is attached to housing 17 by a bracket 81.

Figure 3:
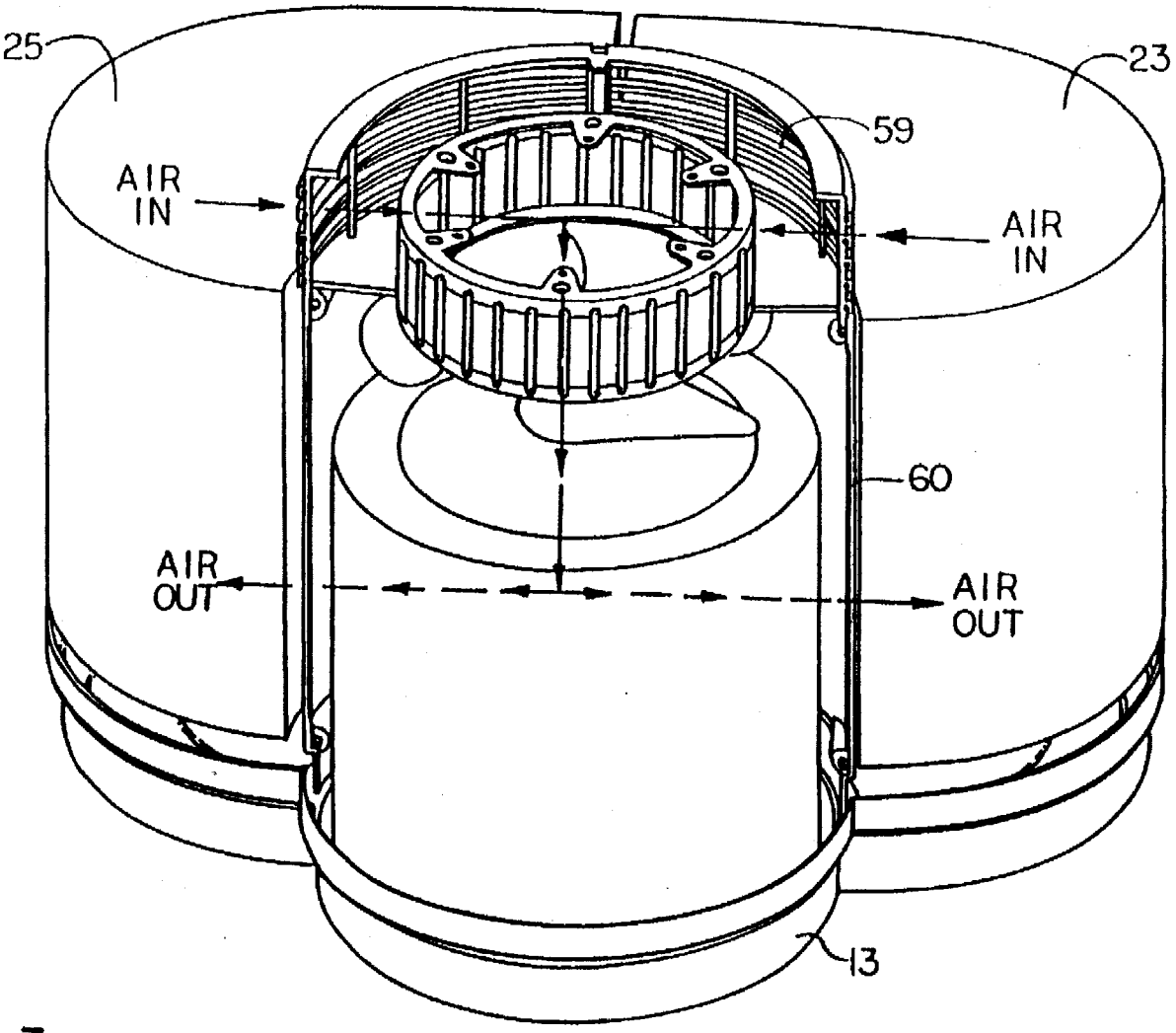
FIG. 3 is a perspective view of the evaporative humidifier shown in FIG. 1, with the top cover and front portion of the housing removed along with all components contained therein except the wick filter, the fan blades and the heater.
Figure 4:
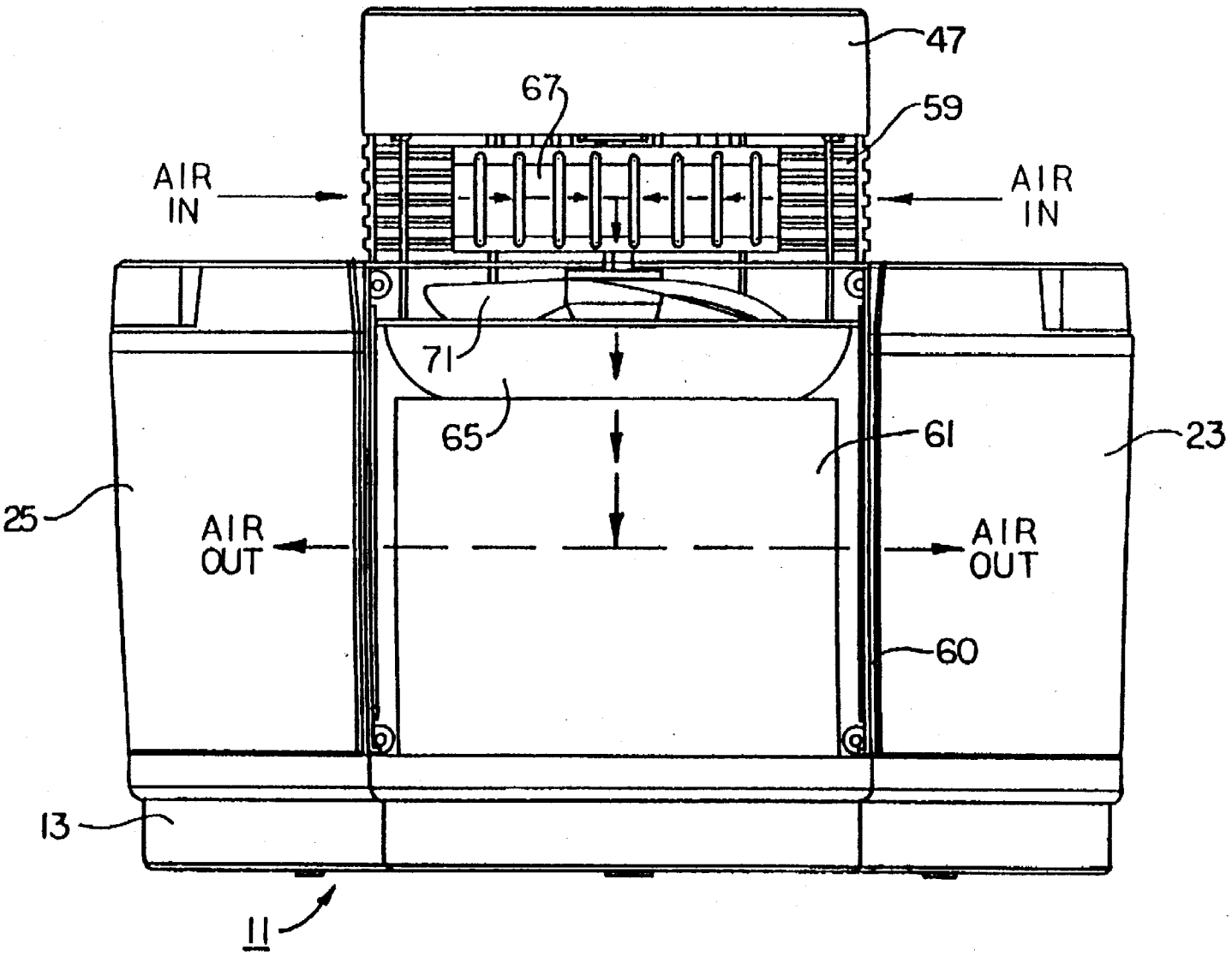
FIG. 4 is a front view of the evaporative humidifier shown in FIG. 1, with the front portion of the housing removed along with all components contained therein except the wick filter, the air deflector, the fan and the heater.
Figure 5:
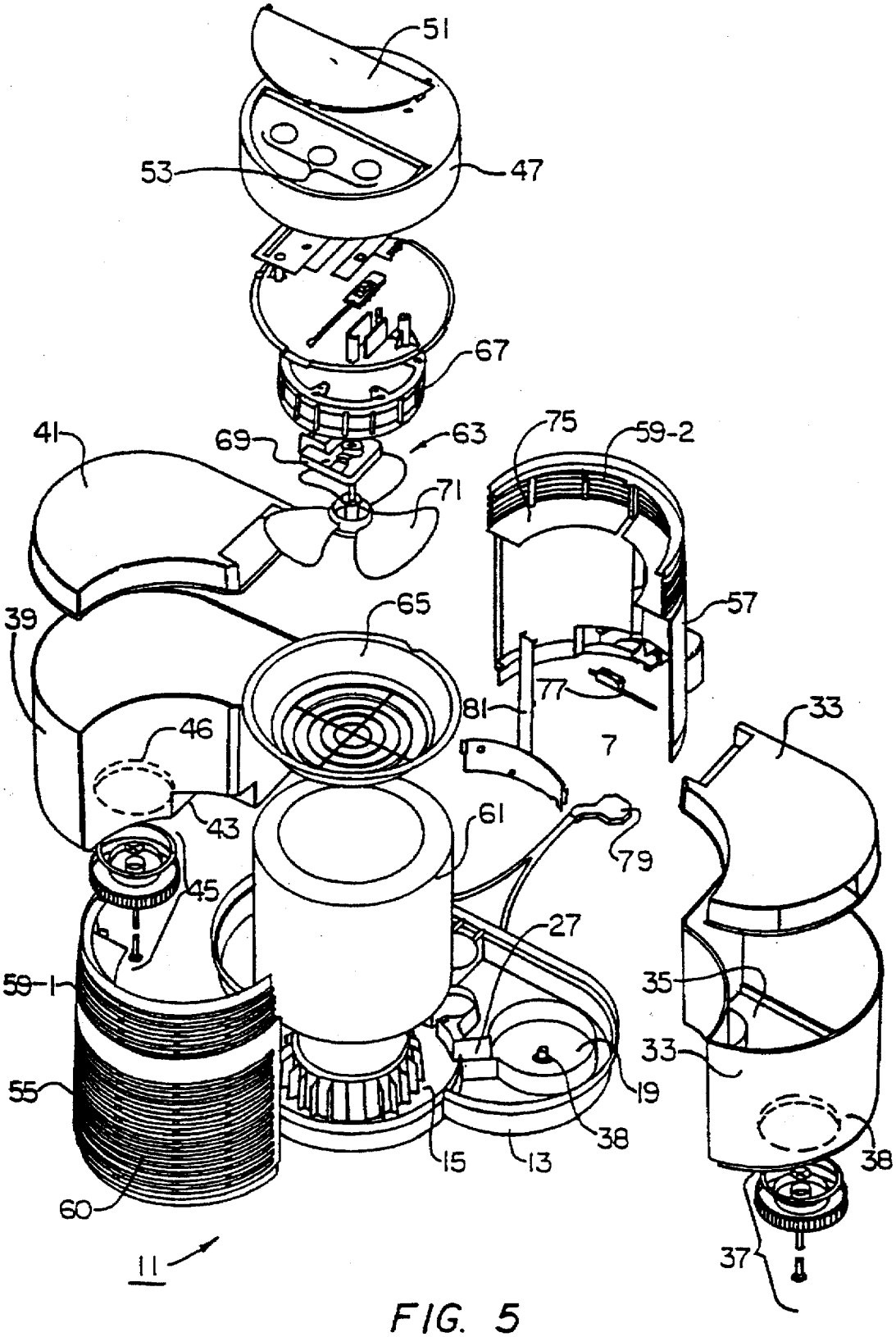
FIG. 5 is an exploded view of the evaporative humidifier shown in FIG. 1.
Figure 6:
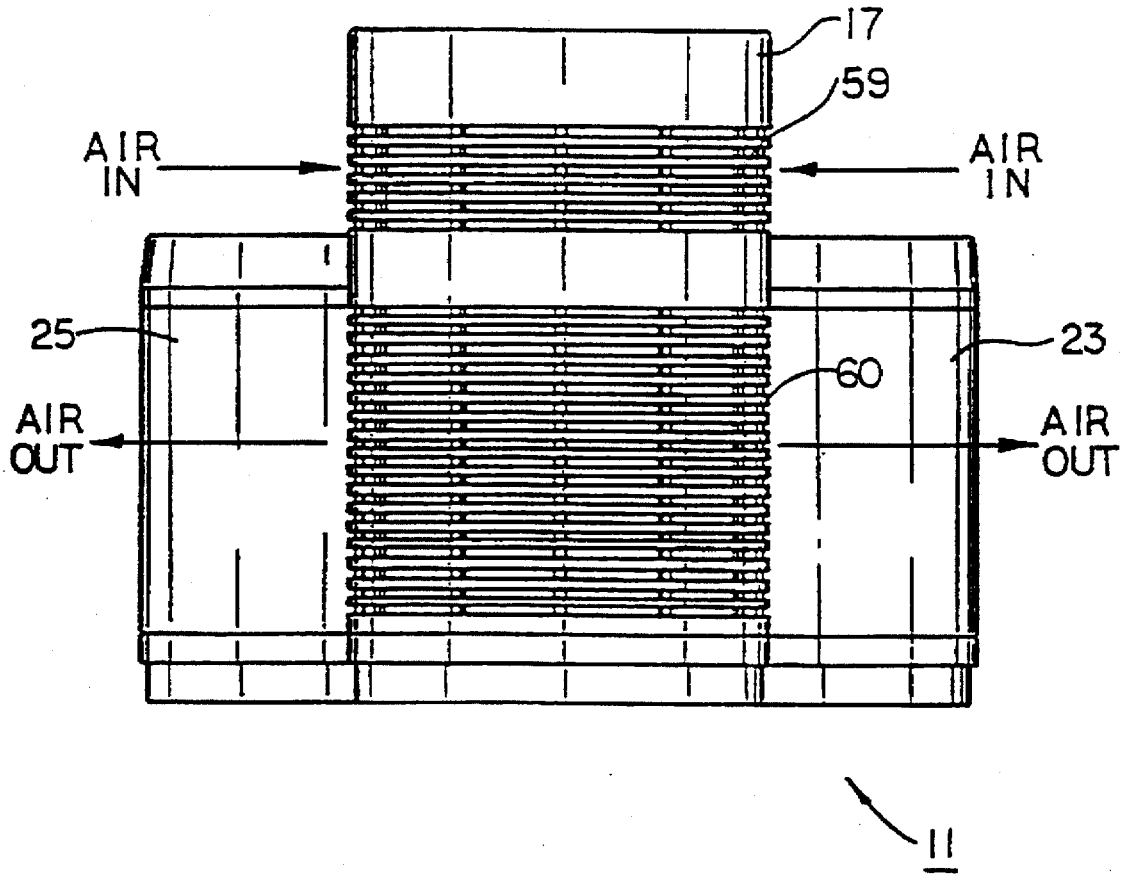
FIG. 6.is a front view of the evaporative humidifier shown in FIG. 1.

In the operation of evaporative humidifier 11, water from water supply tanks 23 and 25 moves from enclosures 19 and 21 into reservoir 15 and then by capillary action up into the non-immersed portion of wick filter 61. Air is drawn in through inlet 59 by fan 63, passes through heater 67 where it is heated, passes down into the center of wick filter 61 from top end 71, passes laterally out through wick filter 61 where it picks up moisture and then exits through outlet grille 61. The flow path is shown by arrows in FIGS. 3 and 4.

The embodiment shown of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A portable evaporative humidifier comprising:

a. base including a portion defining a reservoir for holding water, b. a substantially cylindrical housing mounted on said base over said reservoir, said housing having an air inlet through an upper portion of the housing and an air outlet through a portion of a sidewall of the housing, c. a cylindrically shaped wick filter seated in said reservoir and extending into said housing, said cylindrically shaped wick filter having an open end and a sidewall, d. a cylindrically shaded heater having a radial periphery, said heater being substantially radially aligned with said air inlet and axially aligned with said cylindrically shaped wick filter;

e. a fan positioned below, said heater inside said housing and f. a deflector positioned between said fan and said cylindrically shaped wick filter for directing air flow into said open end of said wick filter;

wherein during operation of said humidifier, air is drawn inside said housing through said air inlet, and through said radial periphery of said heater by said fan thereby heating the air, the heated air is forced by the fan through the deflector into the open end of the wick filter and forced through the sidewall of the wick filter thereby humidifying the air, the humidified air is discharged from the housing through the air outlet.

2. The evaporative humidifier of claim 1, wherein said sidewall of said housing is cylindrically shaped.

3. The evaporative humidifier of claim 1 and further including a heater inside said housing for heating the air drawn in.

4. The evaporative humidifier of claim 3 wherein the heater is positioned to heat the air drawn in before passage into said cylindrically shaped wick filter.

5. The evaporative humidifier of claim 4 wherein said heater is a cylindrically shaped cage resistance wire heater.

6. The evaporative humidifier of claim 5 and further including a deflector for deflecting the air drawn in down into said cylindrically shaped wick filter.

7. The evaporative humidifier of claim 6 further including a water supply tank mounted on said base for supplying water to said reservoir.

8. The evaporative humidifier of claim 7, wherein said air inlet is above said air outlet.

9. The evaporative humidifier of claim 8, wherein said fan includes a motor having a drive shaft and a set of radially extending blades on said drive shaft.

10. The evaporative humidifier of claim 9, wherein said reservoir includes a hub having radially extending ribs for holding said wick filter in its cylindrical shape.

11. The evaporative humidifier of claim 10, wherein said fan is located above said wick filter.

12. The evaporative humidifier of claim 11, wherein said heater is a cage heater.

* * * * *